US006984135B2

(12) United States Patent
Kaneko et al.

(10) Patent No.: US 6,984,135 B2
(45) Date of Patent: Jan. 10, 2006

(54) PRESS FIT PIN

(75) Inventors: Tomonari Kaneko, Yamato (JP); Kimiyasu Makino, Kawasaki (JP); Junichi Miyazawa, Yokohama (JP); Yoshikazu Ito, Yamato (JP)

(73) Assignee: Molex Incorporated, Lisle, IL (US)

( * ) Notice: Subject to any disclaimer, the term of this patent is extended or adjusted under 35 U.S.C. 154(b) by 22 days.

(21) Appl. No.: 10/488,717

(22) PCT Filed: Oct. 1, 2002

(86) PCT No.: PCT/US02/31266

§ 371 (c)(1),
(2), (4) Date: Mar. 4, 2004

(87) PCT Pub. No.: WO03/030306

PCT Pub. Date: Apr. 10, 2003

(65) Prior Publication Data

US 2005/0070139 A1 Mar. 31, 2005

(30) Foreign Application Priority Data

Oct. 1, 2001 (JP) ..... 2001-305505

(51) Int. Cl.
*H01R 12/00* (2006.01)

(52) U.S. Cl. ..... 439/82; 438/873

(58) Field of Classification Search ..... 439/82, 439/751, 825, 873
See application file for complete search history.

(56) References Cited

U.S. PATENT DOCUMENTS 4,762,498 A * 8/1988 Harting et al. ..... 439/82
5,035,659 A * 7/1991 Peterson ..... 439/751
5,738,550 A * 4/1998 Sakuraoka et al. ..... 439/751
6,231,402 B1 * 5/2001 Kikuchi ..... 439/751

FOREIGN PATENT DOCUMENTS

DE 3535074 A1 * 4/1987

* cited by examiner

*Primary Examiner*—Khiem Nguyen
(74) *Attorney, Agent, or Firm*—Robert J. Zeitler

(57) ABSTRACT

A press fit pin of the present invention has a press-fitted region to be press-fitted and connected to a conductive through hole of a printed circuit board or other circuit substrate. The press-fitted region is formed into substantially an M-shape in cross-section, which has two beam-like regions extending substantially in parallel, and a connection region connecting the beam-like regions in a deformable manner. The connection region is formed into such an arcuate shape in cross-section that an upper surface corresponding to a valley side of the M-shape is a concave surface and an opposite lower surface is a convex surface. A part of the upper surface is partially located on the lower surface side with respect to a straight line L connecting left and right inner side continuous portions where the lower surface of the connection region and inner surfaces of the two beam-like regions are continuous to each other.

8 Claims, 7 Drawing Sheets

PRIOR ART

PRESS FIT PIN

FIELD OF THE INVENTION

The present invention relates to a press fit pin having a press-fitted region to be press-fitted to a conductive through hole of a printed circuit board or other circuit substrate.

BACKGROUND OF THE INVENTION

As a press fit pin (a terminal) having a press fitted region to be press-fitted and connected to a conductive through hole of a printed circuit board, one having the press fitted region, in which substantially parallel beam-like regions are connected by a deformable connection region, is known.

This press fit pin is designed so that, when the press-fitted region is press-fitted to the conductive through hole, outer corner portions of the outer surfaces of the beam-like regions are contacted (pressure-contacted) with the inner wall of the through hole while the connection region is deformed. As a typical example thereof, there is one in which the cross-sectional shape of the press fitted region is formed into an M-shape by the beam-like regions and the connection region (see Japanese Patent Examined Publication No. Sho 60-23471).

The press fit pin of this type is obtained by punching a thin metal plate with die and a punch into a predetermined pin shape, and at the same time molding it into a predetermined cross-sectional shape. In the case of the press fit pin having the press fitted region of M-shape in cross-section, sharpened portions must be provided both in the die and the punch, which correspond to a portion of a downwardly oriented V-shaped valley in the upper central portion thereof, and portions of upwardly oriented V-shaped valleys in the outer lower side thereof, but these shape portions are liable to be damaged during processing of the press fit pin, and thus the punch and die are lowered in durability.

Accordingly, the present inventors and so on of the present application have proposed a technique described in the Japanese Patent No. 2929176 as a press fit pin devised in view of this problem. In this technique, as shown in FIG. 9, a connection region 301 for two beam-like regions 300 and 300 is constructed by a central planar portion 302 extending in a direction substantially perpendicular to the beam-like regions 300 as viewed in a cross-section, and by oblique 303 and 303 extending obliquely outwardly from respective sides of the planar portion 302 and continuous to the respective beam-like regions 300. The press fit pin of the related art as shown in FIG. 9 is not so large in deformable capability of the beam-like regions 300, and an adaptable through hole diameter is limited to a small range.

Additionally, other prior art press fit pins include those disclosed in U.S. Pat. No. 4,762,498 and DE 35 35 074 A1.

However, recently, such a press fit pin has been required that can be adapted to a through-hole of a wide diameter range of, for example, 0.65 mm to 0.8 mm (a range of 0.15 mm) as defined by IEC standards.

Assuming that the conventional press fit pin is applied to the individual conductive through holes having the through hole diameters defined by the IEC standards, a holding force is insufficient with respect to the through hole having the maximum hole diameter of 0.8 mm, and the press-fitted portion may be largely deformed with respect to the through hole of the minimum hole diameter of 0.65 mm to cause a stress concentration and increase in the required insertion force.

OBJECT AND SUMMARY OF THE INVENTION

An object of the present invention is to provide a press fit pin, which can increase the holding force of the press fit pin with respect to a maximum hole diameter of a mating through hole to which the press fit pin is to be inserted, and at the same time that can suppress the stress concentration and the increase of the required insertion force with respect to a minimum hole diameter of the mating through hole, thereby being adaptable to the hole diameters of the conductive through holes in a wider range in comparison with the related art.

To solve these and other problems, a press fit pin of the present invention adopts the following structure. It has a press-fitted region to be press-fitted and connected to a conductive through hole of a printed circuit board. The press-fitted region is formed into substantially an M-shape in cross-section, which has two beam-like regions extending substantially in parallel, and a connection region connecting the beam-like regions in a deformable manner. The connection region is formed into such an arcuate shape in cross-section that an upper surface corresponding to a valley side of the M-shape is a concave surface and an opposite lower surface is a convex surface. A part of the upper surface is partially located in the lower surface side with respect to a straight line connecting left and right inner side continuous portions where the lower surface of the connection region and the inner surfaces of the two beam-like regions are continuous to each other.

According to the present invention, since a part of the upper surface of the M shape is located on the lower surface side with respect to the straight line connecting the left and right inner side continuous portions where the lower surface of the connection region and the inner surfaces of the two beam-like regions are continuous to each other, the connection region can be deformed easily. Therefore, a dimension between press-fitted portions on the outer surfaces of the two beam-like regions can be set sufficiently large. This makes it possible to increase the holding force of the press fit pin upon its insertion into a through hole with the maximum hole diameter, as well as to suppress the stress concentration on the press fit pin and the increase of the insertion force for the press fit pin in the case of its insertion into a through hole with the minimum hole diameter.

In the present invention, it is preferable that the most concaved portion at the center of the upper surface corresponding to the valley side of the M-shape is located in the lower surface side with respect to the straight line connecting the left and right inner side continuous portions. With this structure, the connection region can be easily and uniformly deformed elastically.

It is preferable that the two beam-like regions are reduced in thickness so that they can be elastically deformed when press-fitted to the conductive through hole. By reducing the thickness of the two beam-like regions in this manner, the beam-like regions can be elastically deformed more easily due to the reduced thickness of the beam-like regions. Accordingly, each of the beam-like regions is configured such that the stress concentration stemming from the large deformation of the press-fitted region can be dispersed, and that the increase of the insertion force can be suppressed at the same time.

It is preferable that the radius of curvature of the outer surface of each of the two beam-like regions is set larger than the radius of curvature of the inner wall surface of the conductive through hole. This makes it possible to effectively bring the outer surface of each beam-like region into tight contact with the inner wall surface of the conductive through hole. That is, by pressure-contacting the outer surfaces with the inner wall surface of the conductive through hole while elastically deforming the beam-like regions, the holding force of the press fit pin can be increased.

The outer surface of each of the two beam-like regions may be substantially equal in radius of curvature to the inner wall surface of the conductive through hole. By making the radius of curvature of the outer surface of each beam-like region substantially equal to the radius of curvature of the inner wall surface of the conductive through hole, the outer surface of the beam-like region can be tightly and substantially uniformly contacted with the inner wall surface of the conductive through hole. Therefore, the stress concentration stemming from large deformation can be effectively dispersed over the entire beam-like regions.

It is preferable that the two beam-like regions are formed such that, when the press-fitted region is press-fitted to the conductive through hole, the outer surfaces of the beam-like regions are pressure-contacted with the inner wall surface of the conductive through hole while the connection region is deformed. With this structure, by the deformation effect of the connection region and the beam-like regions, it is possible to further enhance the effects of increasing the holding force of the press fit pin, dispersing the stress, reducing the insertion force, etc.

It is preferable that both of the inner side continuous portions where the inner surfaces of the two beam-like regions and the lower surface of the connection region are continuous to each other is formed as a curved surface. With such a configuration, most part of the surface of the press-fitted region is formed by the curved surface. This makes it possible to elastically deform the entire press-fitted region substantially uniformly without any partial nonuniformity when the press-fitted region is elastically deformed. Accordingly, also in view of this point, it is possible to enhance the effects of increasing the holding force of the press fit pin, dispersing the stress, reducing the insertion force, etc.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
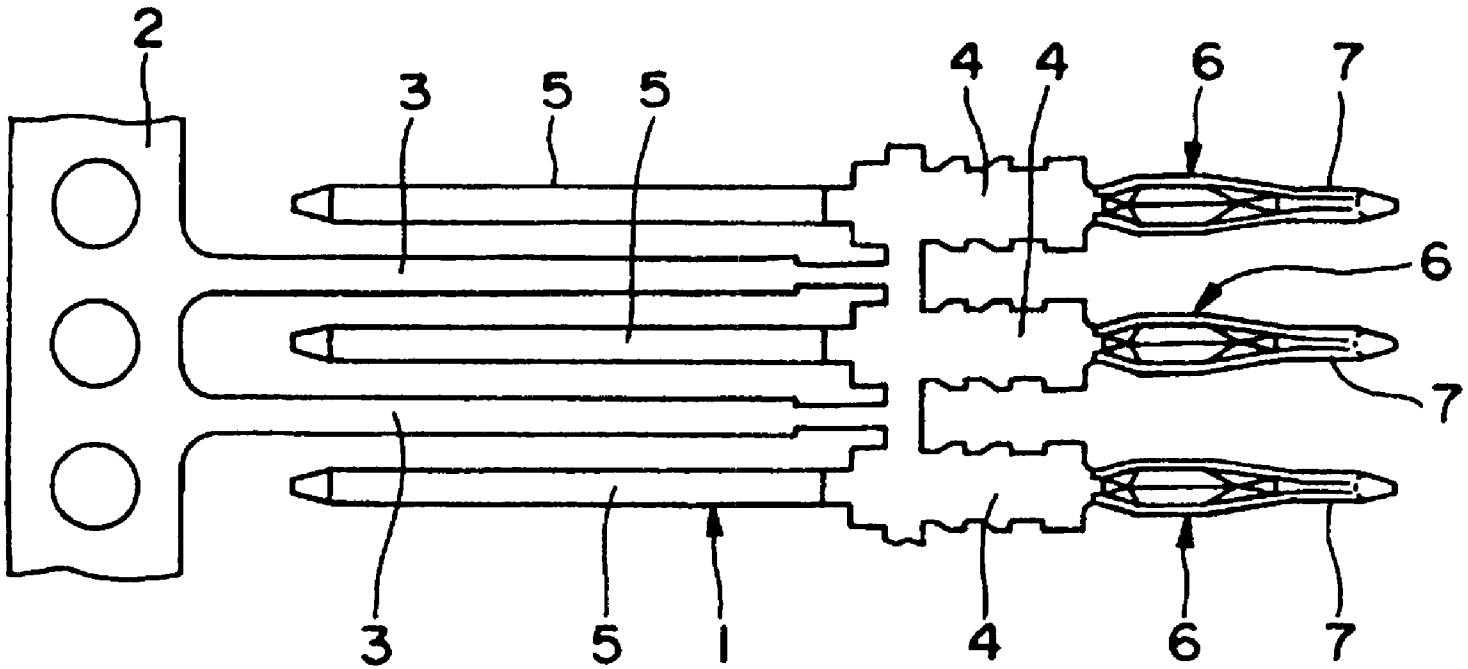
FIG. 1 is a plane view of a press fit pin according to the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Hereafter, an embodiment of the present invention will be discussed with reference to the accompanying FIGS. 1 to 8.

Figure 2:
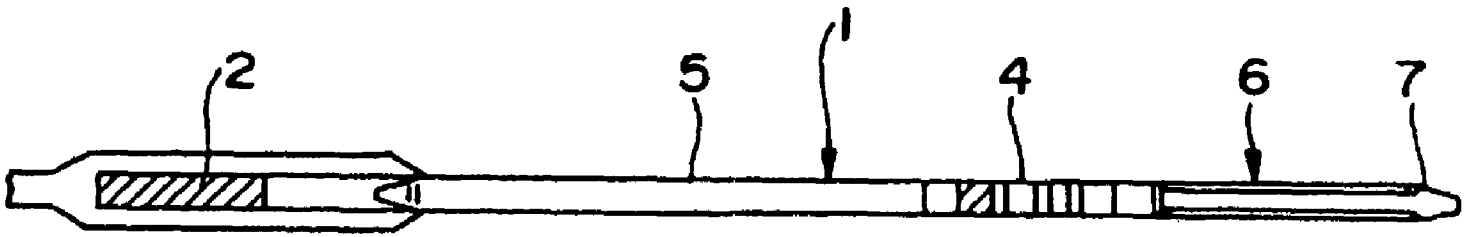
FIG. 2 is a front view of the press fit pin according to the present invention.

A press fit pin 1 shown in these drawings is obtained by punching a thin metal plate with a punch and a die (not shown) and molding it. More specifically, a plurality of press fit pins 1 are manufactured such that they are arranged in parallel on one side of a carrier 2 at given intervals with interconnection bars 3 interposed between them, as shown in FIGS. 1 and 2.

The press fit pin 1 has such a structure that a first pin 5 straightly extends from one side of a rectangular base plate portion 4, and a second pin 7 straightly extends, via a press-fitted region 6 to be press-fitted and connected to a conductive through hole 20 of a printed circuit board B, from the other side of the base plate portion 4. Accordingly, the press fit pin 1 includes the first pin 5, the base plate portion 4, the press-fitted region 6 and the second pin 7 that are concentric to each another.

Figure 3:
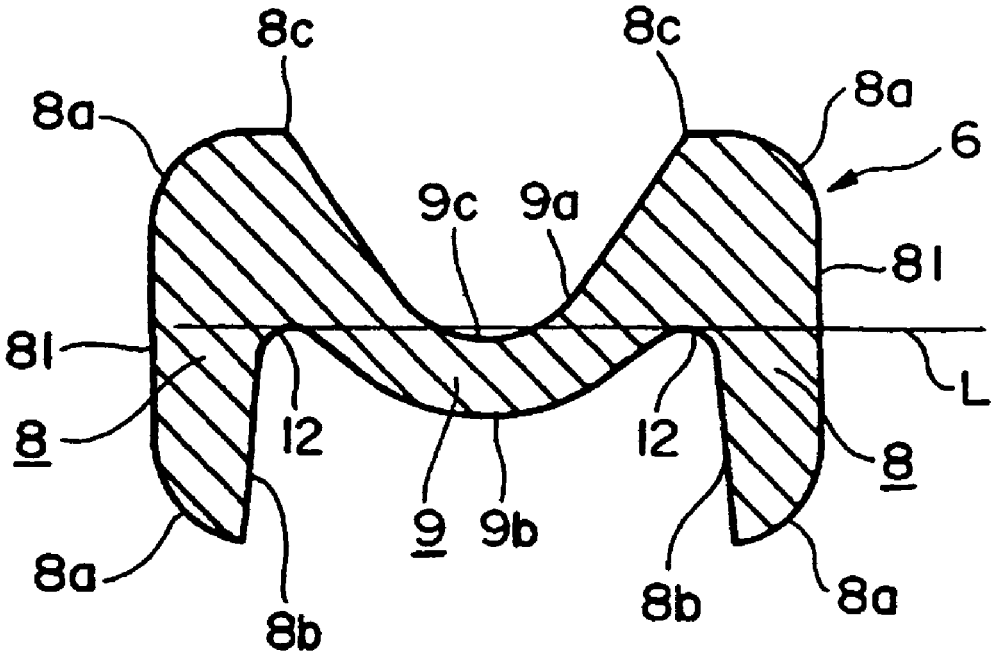
FIG. 3 an enlarged sectional view of a press-fitted region of the press fit pin according to the present invention.

The cross-sectional shape of the press-fitted region 6 is shown in FIG. 3. That is, the press-fitted region 6 has such a shape that substantially parallel two beam-like regions 8 are made continuous to a deformable connection region 9. By this shape, when the press-fitted region 6 is press-fitted to the conductive through hole 20 of the printed circuit board B, both of the outer surfaces 81 of the two beam-like regions 8 are pressure-contacted with an inner wall surface 21 of the conductive through hole 20.

The press-fitted region 6 is designed such that, at this time, at least outer corner portions 8*a* of the respective outer surfaces 81 of the beam-like regions 8 are pressure-contacted with the inner wall surface 21. Accordingly, each of the outer corner portions 8*a* is formed in an arcuate shape in cross-section. In the outer surface 81 of each beam-like region 8, an outer surface portion between the outer corner portions 8*a* is formed as a planar surface.

A feature of this press fit pin 1 resides in the structure of the press-fitted region. As shown in FIG. 3, it is formed in an M-shape in cross-section by the two beam-like regions 8 and the connection region 9. The connection region 9 is formed into an arcuate bent portion in cross-section, that has a concave upper surface 9*a* corresponding to a valley side of the M-shape, and a convex lower surface 9*b* opposite therefrom. Further, a part of the upper surface 9*a* is positioned on the lower surface 9*b* side with respect to a straight line L that connects left and right inner side continuous portions 12 where the lower surface 9*b* of the connection region 9 and inner surfaces 8*b* and 8*b* of the two beam-like regions 8 are continuous to each other.

In this embodiment, the most concaved portion 9*c* at the center of the upper surface corresponding to the valley side of the M-shape is set to be located on the lower surface 9*b* side with respect to the straight line L connecting the left and right inner side continuous portions 12. With this structure, the connection region 9 can be easily and uniformly deformed elastically.

The two beam-like regions 8 are reduced in thickness so that they can be elastically deformed when press-fitted to the conductive through hole 20. By reducing the thickness of the two beam-like regions 8, the beam-like regions 8 can be elastically deformed more easily because of the reduced thickness of the beam-like regions 8. Accordingly, each of the beam-like regions 8 is configured such that the stress concentration stemming from large deformation of the beam-like regions 8 can be dispersed, and that the increase of the required insertion force can be suppressed at the same time.

The radius of curvature of the outer surface 81 of each beam-like region 8 is larger than the radius of curvature of the inner wall surface 21 of the conductive through hole 20. This is because the outer surface 81 of each beam-like region 8 can be thus effectively brought into tight contact with the inner wall surface 21 of the conductive through hole 20. That is, by pressure-contacting the outer surfaces 81 with the inner wall surface 21 of the conductive through hole 20 while elastically deforming the beam-like regions 8, the holding force of the press fit pin can be increased. To fully exhibit this holding force, a diagonal dimension among the outer corner portions 8*a* serving as the press-fitted portions must be set to be larger than a hole diameter (the maximum hole diameter) of the conductive through hole 20.

The outer surface 81 of each beam-like region 8 may be substantially equal in radius of curvature to the inner wall surface 21 of the conductive through hole 20. By making the radius of curvature of the outer surface 81 of each beam-like region 8 substantially equal to the radius of curvature of the inner wall surface 21 of the conductive through hole 20, the outer surface 81 of the beam-like region 8 can be tightly contacted with the inner wall surface 21 of the conductive through hole 20 substantially uniformly. This can effectively disperse the stress concentration stemming from large deformation over the entire beam-like region.

Figure 7:
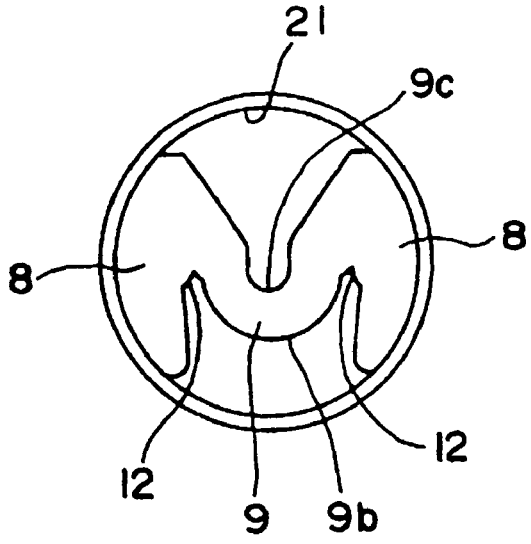
FIG. 7 is a sectional view showing an elastically deformed state of the press-fitted region of the press fit pin according to the present invention with respect to a minimum hole diameter.
Figure 8:
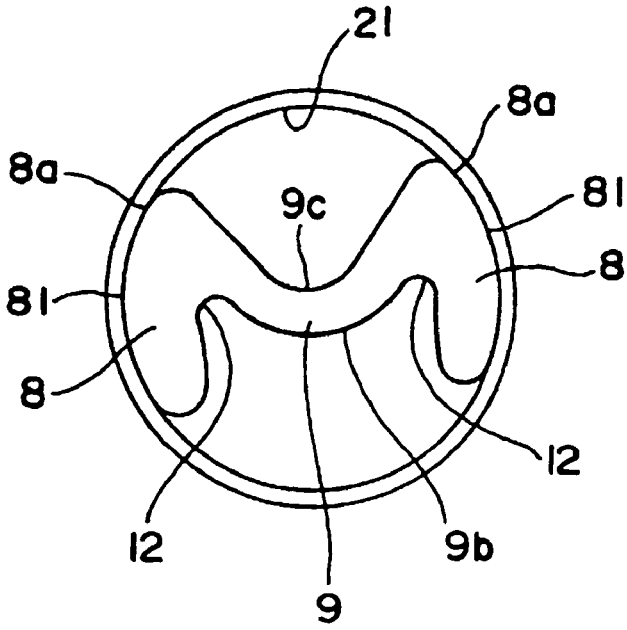
FIG. 8 is a sectional view showing an elastically deformed state of the press-fitted region of the press fit pin according to the present invention with respect to a maximum hole diameter.
Figure 9:
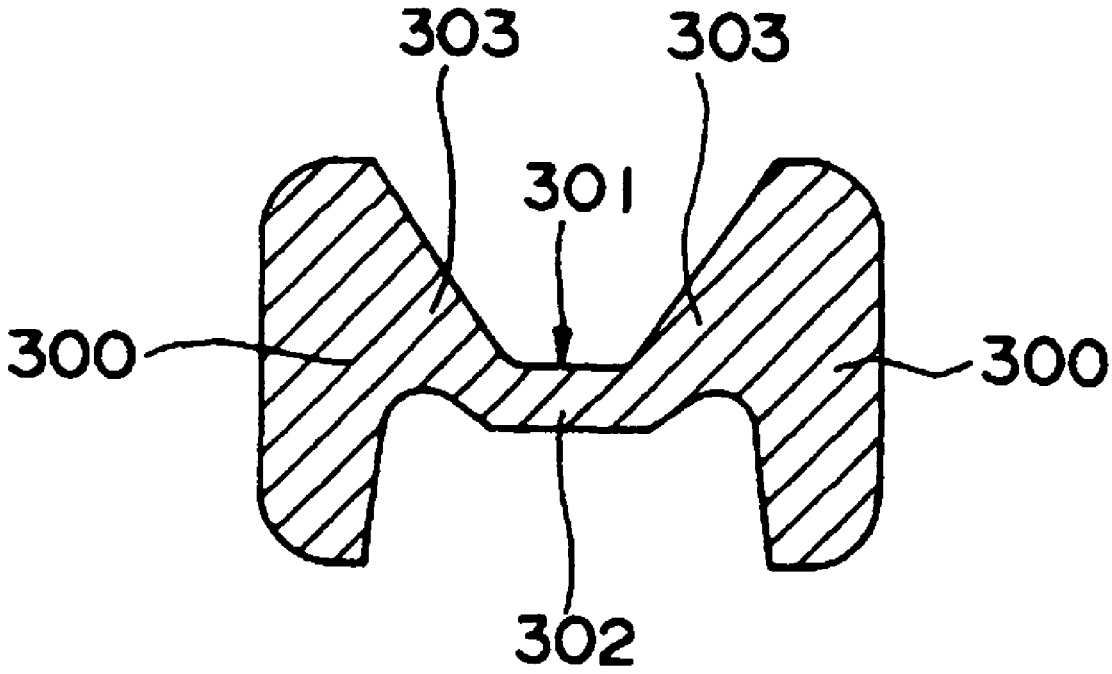
FIG. 9 is an enlarged sectional view of a press-fitted region of a press fit pin in a related art.

In this embodiment, the two-beam-like regions 8 are so constructed that, when the press-fitted region 6 is press-fitted to the conductive through hole 20, as shown in FIGS. 7 and 8, mainly the connection region 9 is deformed, while the bean-like regions 8 are also (slightly) deformed so that the outer surfaces 81 of the beam-like regions 8 are pressure-contacted with the inner wall surface 21 of the conductive through hole 20.

That is, as shown in FIG. 8, in the case of a conductive through hole 20 having the maximum hole diameter (for example, 0.8 mm), mainly the connection region 9 is deformed, and the beam-like regions 8 are also deformed a little so that the outer surfaces 81 are pressure-contacted with the inner wall surface 21, thereby providing a sufficient holding force.

On the other hand, as shown in FIG. 7, in case of a conductive through hole 20 having the minimum hole diameter (for example, 0.65 mm), the connection region 9 is largely deformed, and the entire beam-like regions 8 are also deformed slightly so that the outer surfaces 81 are pressure-contacted with the inner wall surface 21. Therefore the stress is dispersed, while the increase of the required insertion force is suppressed.

Each of the inner side continuous portions 12 where the inner surfaces 8*b* of the two beam-like regions 8 and the lower surface 9*b* of the connection region 9 are continuous to each other is formed as a curved surface. Consequently, most part of the surface of the press-fitted region 6 is formed by the curved surface. This makes it possible to elastically deform the entire press-fitted region 9 substantially uniformly without any partial nonuniformity when the press-fitted region 6 is elastically deformed. Accordingly, also in view of this point, it is possible to enhance the effects of increasing the holding force of the press fit pin, dispersing the stress, reducing the insertion force required, etc.

Figure 4:
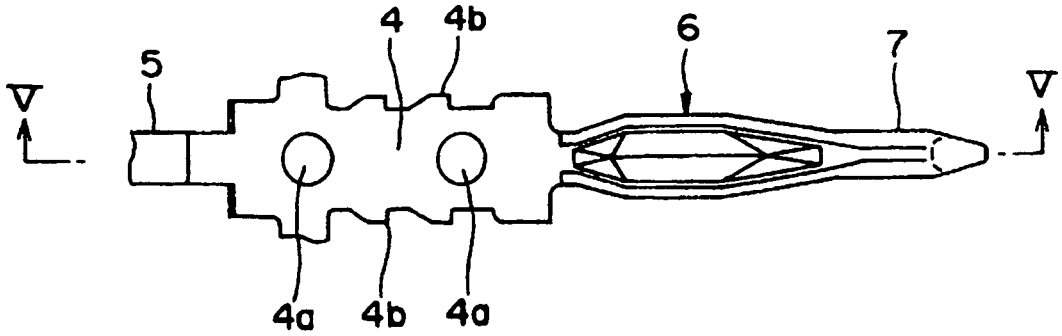
FIG. 4 is an enlarged plane view of a base plate portion and a press-fitted region of the press fit pin according to the present invention.
Figure 5:
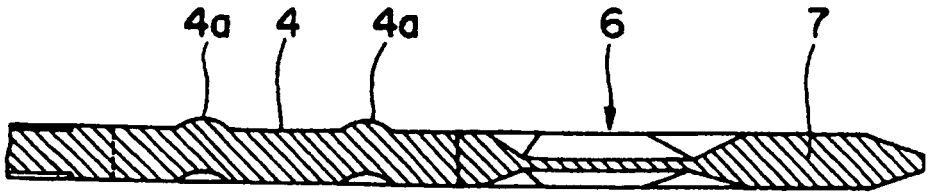
FIG. 5 is a sectional view taken along a line V—V of FIG. 4.
Figure 6:
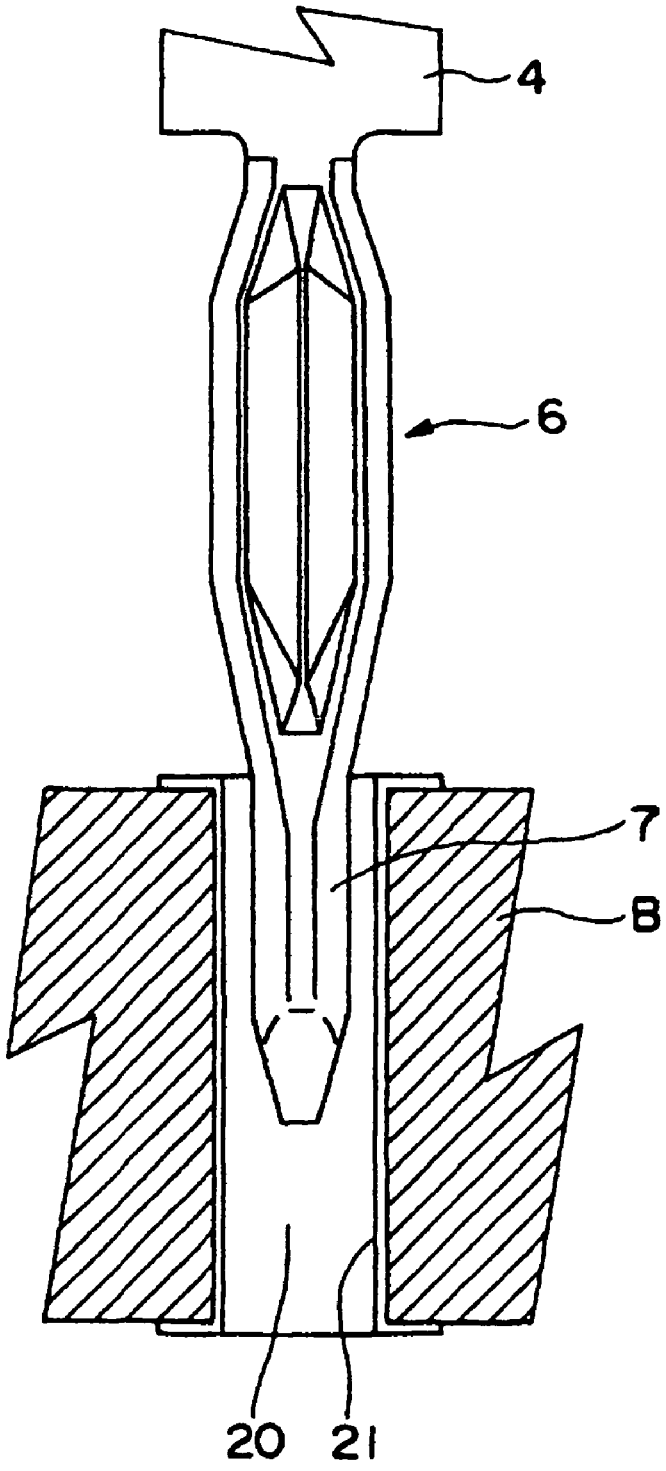
FIG. 6 is a partial sectional view showing a relationship between the press fit pin according to the present invention and a printed circuit board having conductive through hole.

FIGS. 4 and 5 show, in an enlarged manner, a portion of the press fit pin 1 from the base plate portion 4 to the press-fitted region 6. The base plate portion 4 is formed with two dimples (protrusions) 4*a* protruded from the surface thereof. A plurality of lances 4*b* are formed in edge portions of the base plate 4, which are, for example, to bite into terminal mounting holes of a housing of a connector to mount the press fit pin 1.

To use this press fit pin 1, an individual press fit pin 1 is cut off and separated from the carrier 2. In a state in which the press fit pin 1 is mounted to the housing, the first pin 5 constitutes a pin contact.

Since the most concaved portion 9*c* of the upper surface 9*a* of the connection region 9 is disposed at a position corresponding in height to substantially center positions of the beam-like regions 8, when the press fit pin 1 is press-fitted to the conductive through hole 20 of the printed circuit board, the contact pressures of the outer corner portions 8*a* (at four locations) of the beam-like regions 8 against the inner wall of the conductive through hole can be made substantially uniform.

An experiment was actually conducted to investigate a relationship between the through hole diameter and the insertion force or holding force of the press fit pin according to the present invention by inserting the press fit pin of the present invention which is gold-plated or solder plated into through holes having through hole diameters (0.65 mm to 0.8 mm) adopted by the IEC standards. It was found through the experiment that, as the through hole diameter becomes smaller, both the insertion force required and holding force of the press fit pin becomes greater.

Further, it was also found that even though the through hole diameter is in such a wide range of from 0.65 mm to 0.8 mm, the obtained insertion force and holding force both fully satisfy the respective target performances such that the insertion force in case of the minimum hole diameter, 0.65 mm, is smaller than a desired value, and the holding force in case of the maximum hole diameter, 0.8 mm, is larger than a desired value.

While a preferred embodiment of the present invention is shown and described, it is envisioned that those skilled in the art may devise various modifications of the present invention without departing from the spirit and scope of the appended claims.

What is claimed is:

1. A press fit pin (1) comprising a press-fitted region (6) to be press-fitted and connected to a conductive through hole (20) of a circuit substrate (B), the press fit pin characterized in that:

the press-fitted region is formed into substantially an M-shape in cross-section, the substantially M-shape comprising two beam-like regions (8) extending substantially in parallel, and a connection region (9) connecting the beam-like regions in a deformable manner, the connecting region not extending downward beyond a distal end of the beam-like regions, wherein the connection region is formed into such an arcuate shape in cross-section that the upper surface of the arcuate shape corresponds to a valley side of the M-shape, is a concave surface (9*a*) and has only a single arcuate shape extending between the two beam-like regions, and an opposite lower surface of the arcuate shape is a convex surface (9*b*), wherein the lower surface includes left and right inner side continuous portions (12) where the lower surface of the connection region and inner surfaces of the two beam-like regions (8*b*) are continuous to each other; and wherein a part of the upper surface (9*a*) is located below a straight line (L) connecting the left and right inner side continuous portions.

2. The press fit pin according to claim 1, wherein the most concaved portion at the center of the upper surface (9*c*) is located below the straight line (L) connecting the left and right inner side continuous portions (12).

3. The press fit pin according to claim 1, wherein the radius of curvature of the outer surface (81) of each of the two beam-like regions (8) is larger than the radius of curvature of an inner wall surface (21) of the conductive through hole (20).

4. The press fit pin according to claim 1, wherein the radius of curvature of the outer surface (81) of each of the two beam-like regions (8) is substantially equal to the radius of curvature of an inner wall surface (21) of the conductive through hole (20).

5. The press fit pin according to claim 1, wherein the two beam-like regions are formed such that, when the press-fitted region is press-fitted to the conductive through hole (20), the outer surfaces (81) of the beam-like regions (8) are pressure-contacted with the inner wall surface (21) of the conductive through hole (20) while the connection region (9) is deformed.

6. The press fit pin according to claim 1, wherein the press fit pin is capable of being received within a through hole (20) in the substrate having a diameter of 0.65 mm.

7. The press fit pin according to claim 1, wherein the press fit pin is capable of being received within a through hole (20) in the substrate having a diameter of 0.80 mm.

8. The press fit pin according to claim 1, wherein the press fit pin is capable of being received within a through hole (20) in the substrate having a range of diameters from 0.65 mm to 0.80 mm.

* * * * *